United States Patent [19]

Hill

[11] 3,974,761

[45] Aug. 17, 1976

[54] COIL COMPACTOR

[75] Inventor: William J. Hill, Holden, Mass.

[73] Assignee: Morgan Construction Company, Worcester, Mass.

[22] Filed: May 15, 1975

[21] Appl. No.: 577,709

[52] U.S. Cl. ..... 100/7; 100/3; 100/12; 100/264; 100/295; 140/1

[51] Int. Cl.[2] ..... B65B 13/20

[58] Field of Search ..... 100/7, 3, 12, 264, 295; 140/1

[56] References Cited

UNITED STATES PATENTS

| | | | |
|---|---|---|---|
| 3,195,444 | 7/1965 | McLean | 100/7 |
| 3,400,652 | 9/1968 | Hill et al. | 100/7 |
| 3,583,311 | 6/1971 | Hill et al. | 100/7 |
| 3,648,736 | 3/1972 | Hill | 140/1 |
| 3,710,711 | 1/1973 | Boehm | 100/3 |
| 3,797,381 | 3/1974 | Glasson | 100/12 |
| 3,908,712 | 9/1975 | Paletzki | 140/1 |
| 3,921,510 | 11/1975 | Glasson | 100/7 |

*Primary Examiner*—Billy J. Wilhite

*Attorney, Agent, or Firm*—Thompson, Birch, Gauthier & Samuels

[57] ABSTRACT

An apparatus is disclosed for use in a rolling mill in compacting an upstanding cylindrical product coil. The apparatus includes a compacting station having a base platen divided into laterally spaced sections and an overlying vertically movable upper platen. A transport mechanism is employed to carry a coil laterally from a receiving station into the compacting station at an operative position between the platens. The transport mechanism includes a mandrel extending axially through the coil and an elevator head which is held by the mandrel in a raised position supporting the coil bottom at a level above the base platen. Thereafter, a lowering of the upper platen is accompanied by a corresponding gradual axial retraction of the mandrel and a lowering of the elevator head to the level of the base platen. This results in an axial compaction of the coil between the platens while the mandrel continues to provide internal support for the coil. Suitable retaining bands or straps are applied to the compacted coil, after which the upper plate, mandrel and elevator head are returned to their raised positions, and the transport mechanism is employed to move the compacted banded coil laterally from the compacting station to a delivery station.

8 Claims, 18 Drawing Figures

COIL COMPACTOR

BACKGROUND OF THE INVENTION

This invention relates generally to rolling mills where the rolled products are formed into cylindrical coils. The invention is concerned in particular with an apparatus for axially compacting such coils in conjunction with a banding operation.

The compacting devices which have heretofore been employed have been found to be deficient in that they require the coils to slide or roll. Such movements have a tendency to scratch or mar the surface of the coiled product. The known compacting devices also cause distortion of the coil shape. These problems become particularly acute when known compacting devices are employed to handle the larger product coils produced by modern day rolling mills.

It is, accordingly, an object of the present invention to provide an improved compacting apparatus which has the capability of handling all sizes of product coils, without attendant coil distortion or marring of the product surface.

Another object of the present invention is the provision of a compacting apparatus which operates without pushing the coil, or requiring the coil to undergo sliding or rolling.

A further object of the present invention is the provision of means for axially supporting the coil from within during compaction, thereby minimizing any telescoping or shape deformation under heavy compacting forces.

SUMMARY OF THE INVENTION

According to the present invention, there is provided an apparatus which in the preferred embodiment, has a compacting station located between a receiving station and a delivery station. The basic elements of the compacting station include a base platen divided into laterally spaced sections, an upper platen overlying and spaced vertically above the base platen, and a first operating means for vertically displacing the upper platen relative to the base platen during a compacting cycle.

The receiving station includes a U-shaped support onto which coils are received from another remote location. The delivery station is also provided with a U-shaped support onto which coils are delivered after having been compacted and banded at the compacting station. Both of the U-shaped supports have their open ends facing the compacting station located therebetween.

Coils are moved from one station to another by a transport means which includes a carriage mounted for movement along a rail or track running under the stations. The carriage carries an elongated mandrel which is axially adjustable under the influence of a second operating means mounted on the carriage. An elevator head is also mounted on the carriage for vertical movement in relation thereto. The mandrel has fingers thereon which are adapted to engage and vertically adjust the elevator head during certain portions of the mandrel's axial travel. The carriage is moved in opposite directions along its supporting rail or track by a third operating means.

During a typical operating cycle, the carriage is moved to a position underlying the receiving station, with the mandrel fully retracted and with the elevator head adjusted to a level beneath that of the supporting surface of the receiving station's U-shaped support. At this point, the mandrel is aligned axially with the coil. The second operating means is then actuated to extend the mandrel up through the coil. During the latter portion of this axial extension, the mandrel fingers engage and raise the elevator head, which in turn contacts and raises the bottom of the coil off of the receiving station's U-shaped support. With the coil thus supported solely by the mandrel and the elevator head, the third operating means is employed to move the carriage to the compacting station, with the mandrel extending upwardly through the space between the base platen sections, and with the coil bottom supported above the base platen on the elevator head. The first operating means is then actuated to lower the upper platen. This is accompanied by actuation of the second operating means to gradually retract the mandrel, which in turn causes the elevator head to drop into line with the base platen. As the upper platen continues to descend, the coil is compacted between both platens while being continuously supported from within by the mandrel. When the coil is fully compacted, retaining bands are applied. This can be accomplished either manually or automatically by known devices.

Thereafter, the upper platen is returned to its raised position. This is accompanied by an axial extension of the mandrel which again acts through the mandrel fingers to raise the elevator head and the coil bottom above the level of the base platen. With the compacted banded coil thus supported again solely by the elevator head and the mandrel, the carriage is moved to the delivery station, where the mandrel is fully retracted. This is accompanied by a lowering of the elevator head beneath the level of the delivery station's U-shaped support, and the coil is thus deposited directly thereon.

BRIEF DESCRIPTION OF THE DRAWINGS

A preferred embodiment of an apparatus constructed in accordance with the present invention will now be described by way of example only, with reference to the accompanying drawings, wherein.

DESCRIPTION OF PREFERRED EMBODIMENT

Figure 1:
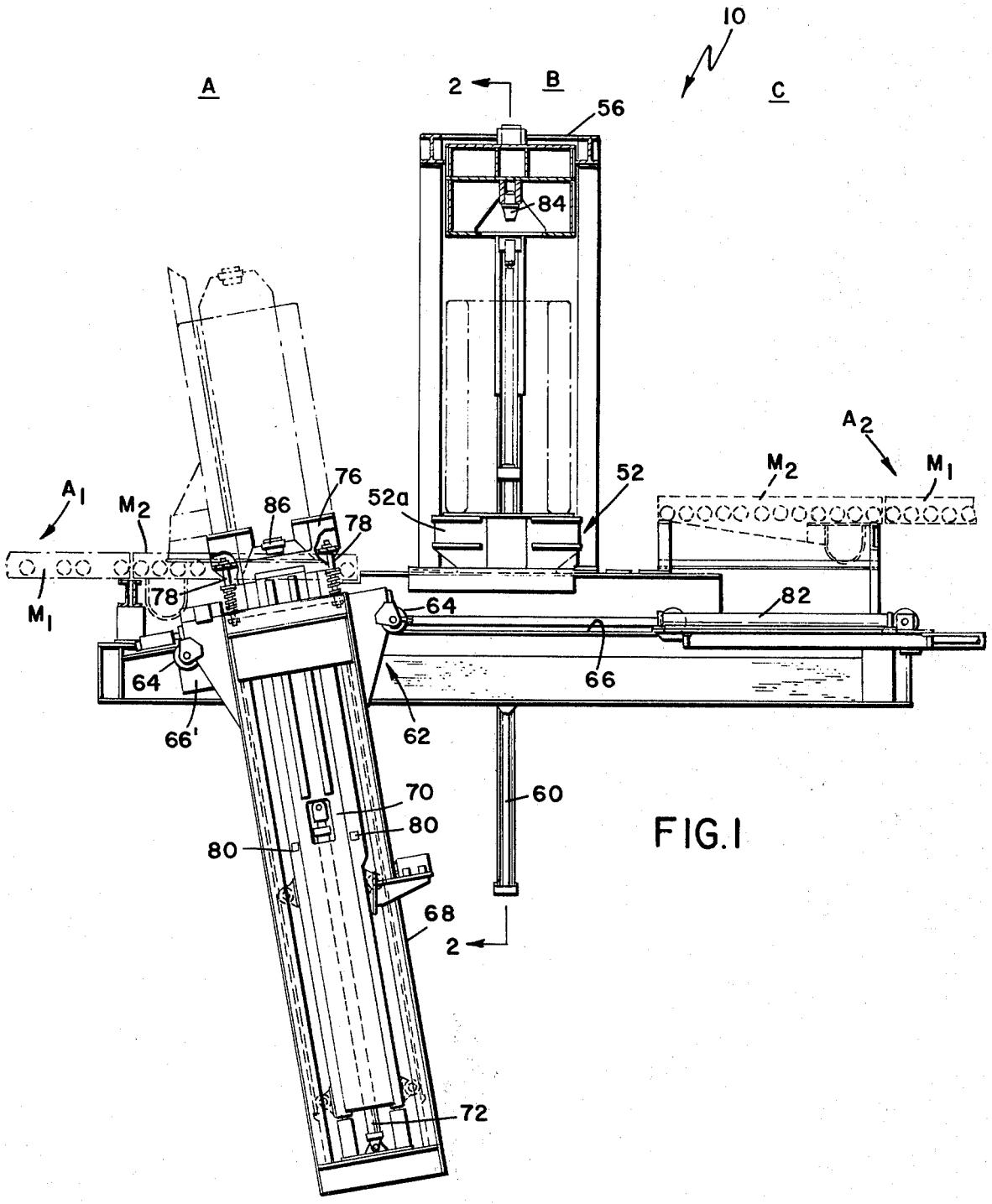
FIG. 1 is a side elevational view of the apparatus.
Figure 2:
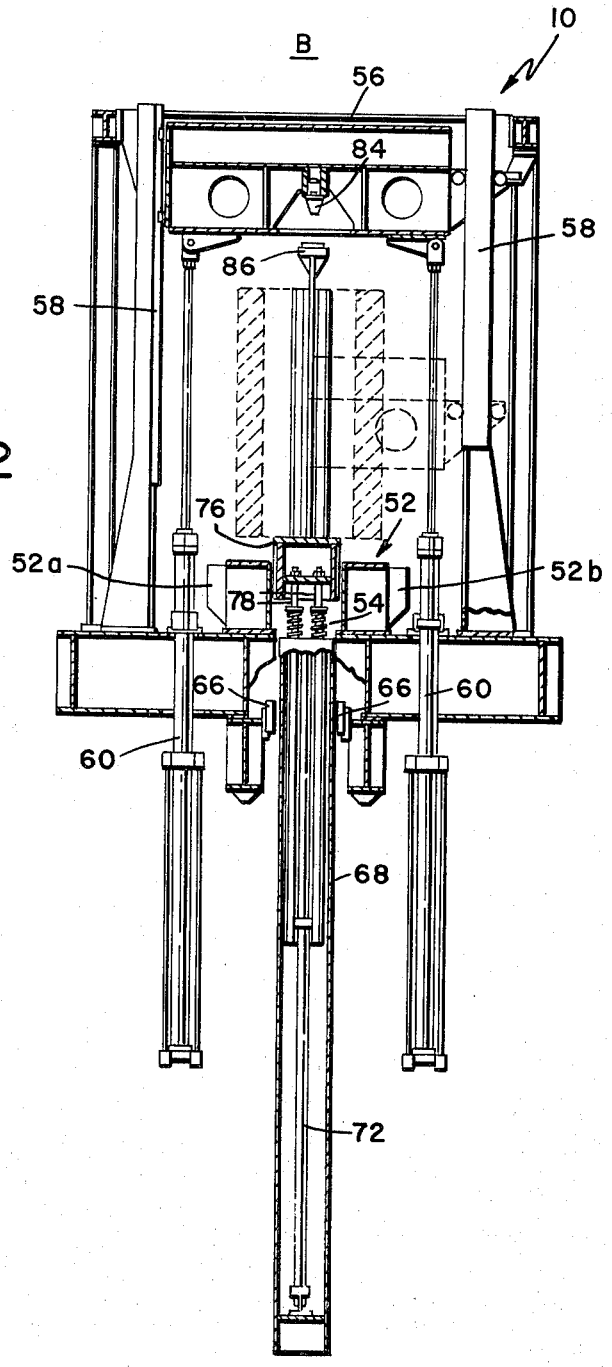
FIG. 2 is a sectional view taken along lines 2—2 of FIG. 1 with the carriage shown at the compacting station and immediately prior to the commencement of a compacting cycle.
Figure 3:
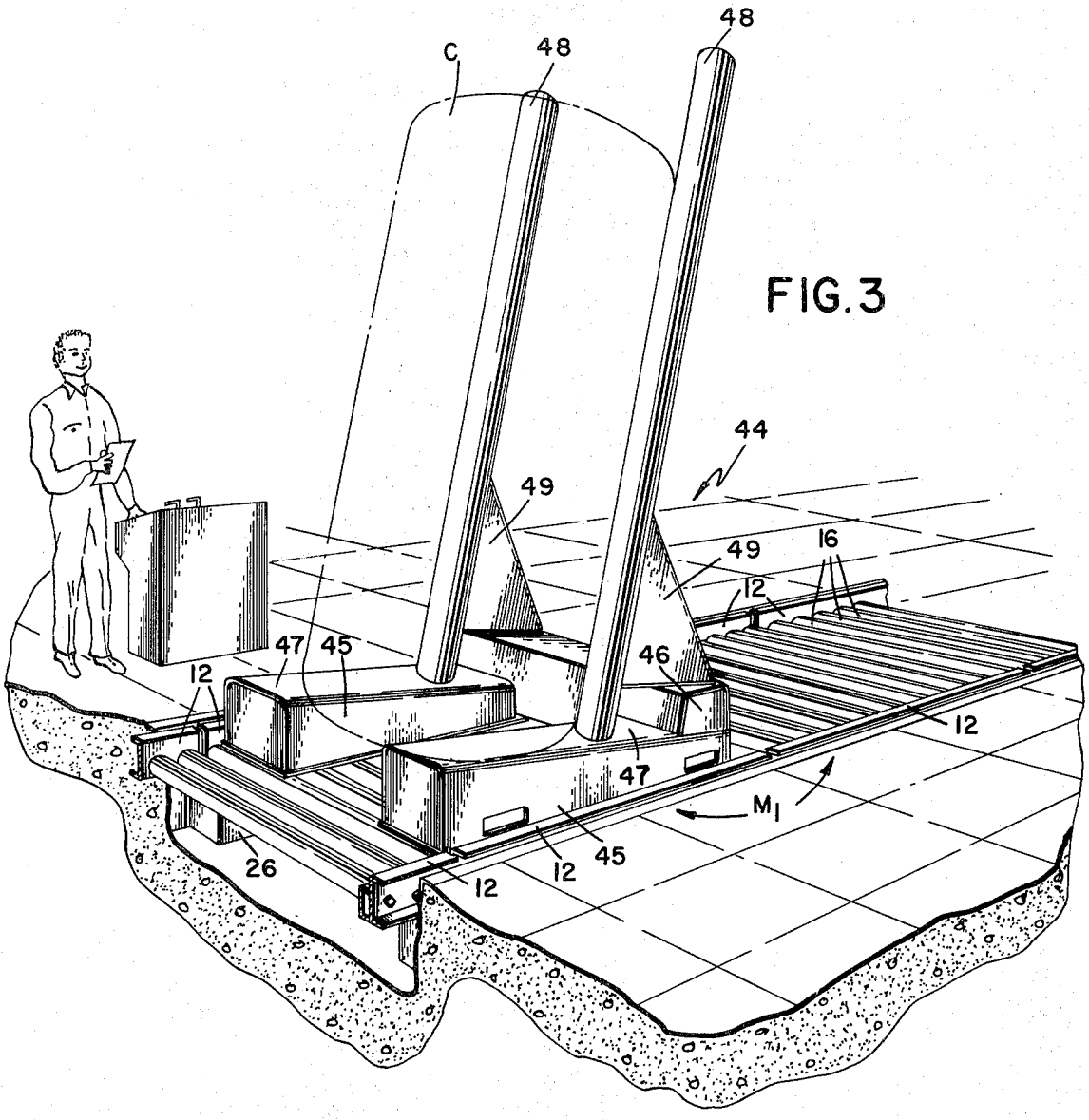
FIG. 3 is a perspective view of a pallet-mounted coil being transported along a typical roller conveyor avenue.
Figure 4:
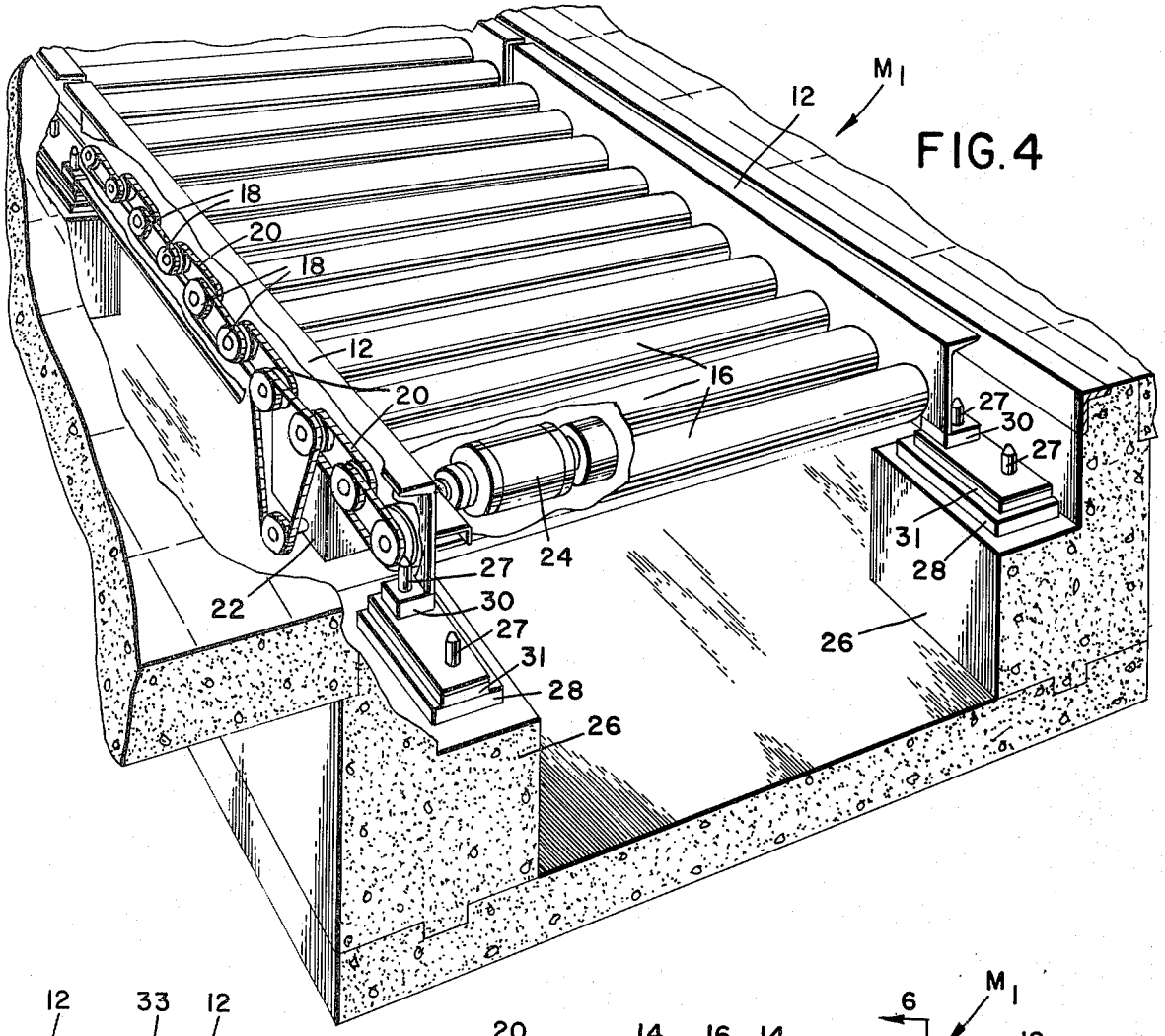
FIG. 4 is a perspective view of one typical roller table module mounted in place with portions of the module and supporting foundation structure broken away.

Referring initially to FIGS. 1 and 2, there is shown at 10 a compacting apparatus in accordance with the present invention. The apparatus may be divided, for descriptive purposes, into a receiving station A, a compacting station B, and a delivery station C.

The receiving station A is located on one side of the compacting station B at the end of a roller conveyor avenue $a_1$. The delivery station C is located on the opposite side of the compacting station B at the beginning of another roller conveyor avenue $a_2$. These roller conveyor avenues are made up of aligned roller table modules $M_1$ and $M_2$, the latter having a special U-shaped configuration designed to accept a transfer mandrel.

Figure 5:
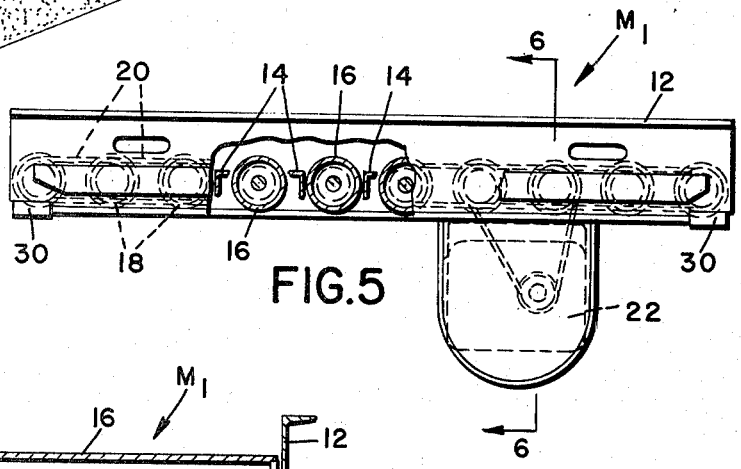
FIG. 5 is a side view of the roller table module shown in FIG. 4.
Figure 7:
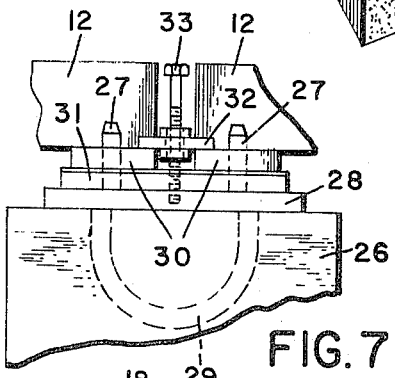
FIG. 7 is a partial elevational view showing one means for retaining the modules on foundation pedestals.
Figure 6:
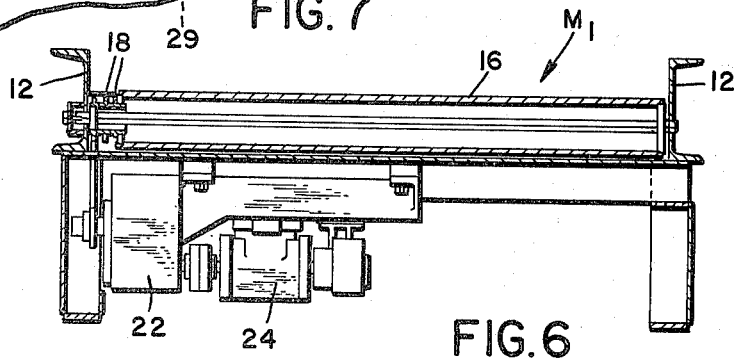
FIG. 6 is a sectional view taken along line 6—6 of FIG. 5.

With reference to FIGS. 3–7, it will be seen that the roller table modules $M_1$ have frame structures comprised basically of side channels 12 interconnected at appropriate locations by bridging members 14 (see FIG. 5). The side channels 12 support the ends of a plurality of laterally extending parallel table rollers 16. The table rollers have either sheaves or sprockets 18 at one end thereof which are interconnected by chains or belts 20. One or more of the rollers are additionally connected by means of appropriate sprockets or sheaves and a chain or belt to the output shaft of a gear reducer 22 which is in turn driven by a motor 24. The gear reducer and motor are located beneath the table rollers 16 and are bolted to a connecting plate extending between the side channels 12.

It will thus be seen that each module $M_1$ is a selfcontained unit which is adapted to be mounted at any desired location, for example on pedestals 26 by means of pins 27 which extend upwardly from plates 28 anchored on the pedestals by means of U-shaped anchors 29. The modules have feet 30 through which the pins 27 protrude. Preferably, resilient pads 31 are interposed between the plates 28 and the feet 30 to dampen vibration and minimize noise. The feet 30 are held down by keeper plates 32 which are held in place by bolt-nut assemblies 33 threaded into tapped holes in the plates 28.

Figure 8:
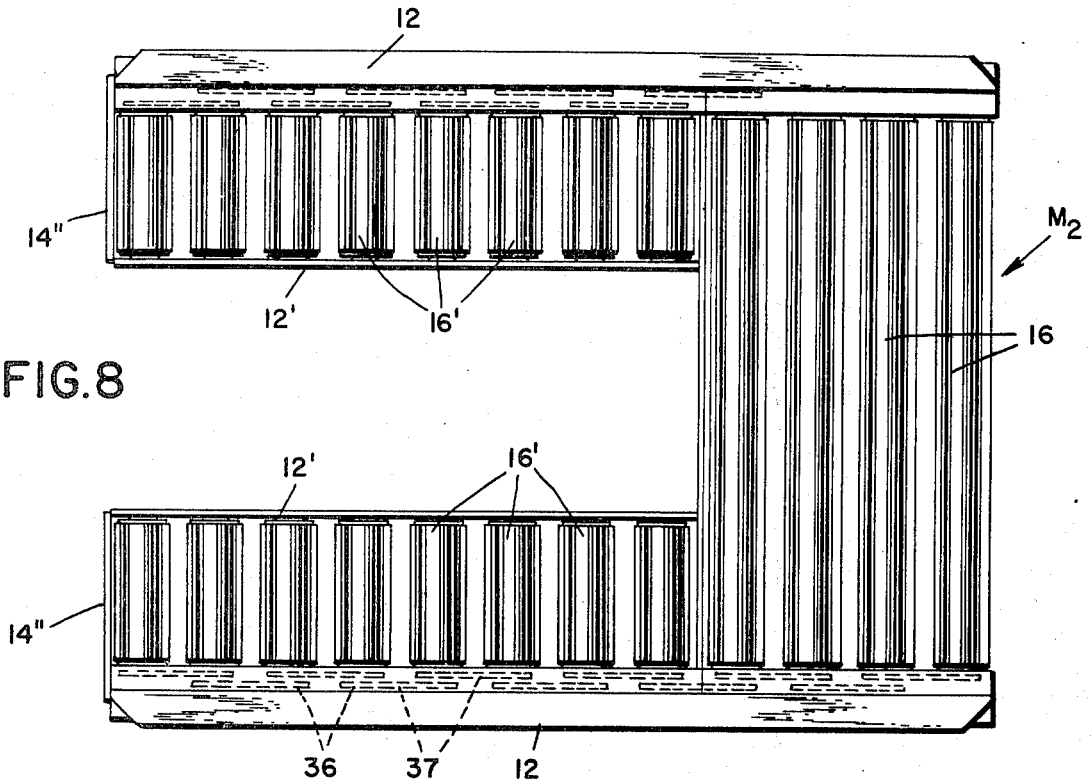
FIG. 8 is a plan view of a roller table module specially designed to accept a mandrel.
Figure 9:
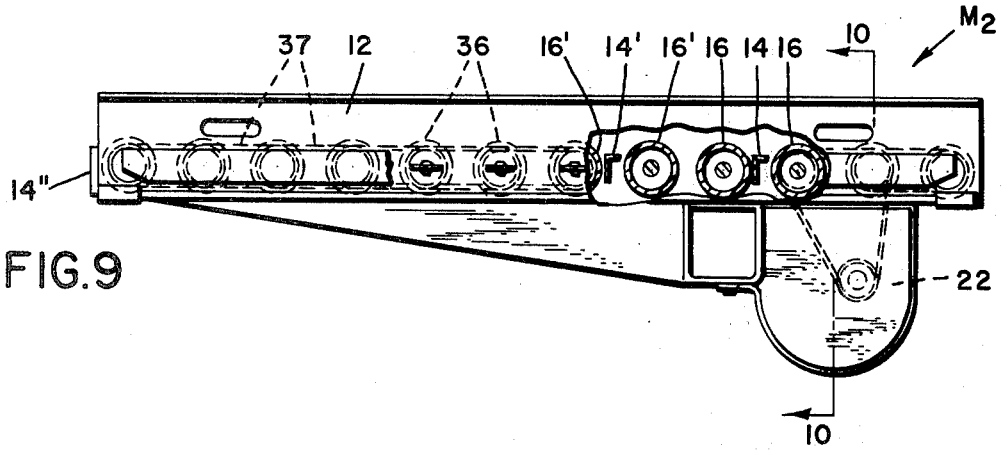
FIG. 9 is a side elevational view of the roller table module shown in FIG. 8.
Figure 10:
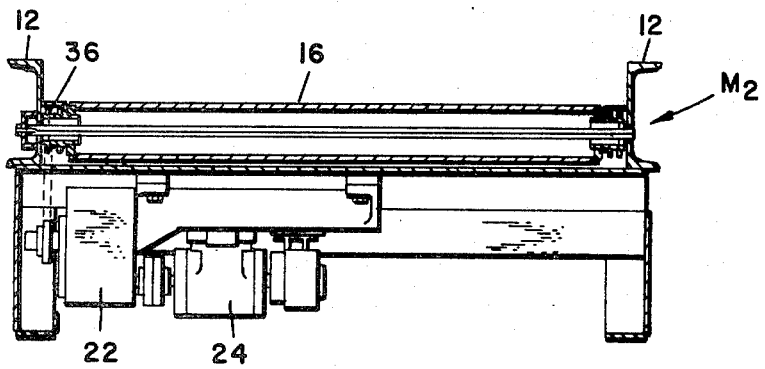
FIG. 10 is a sectional view taken along lines 10—10 of FIG. 9.

With reference to FIGS. 8 to 10, it will be seen that the roller table modules $M_2$ are similar to the modules $M_1$ in that the former are also provided with side channels 12 suitably interconnected by bridging members 14 and 14'. Certain of the table rollers 16 extend laterally between the side members 12, while others indicated at 16' are shorter in length and extend between the adjacent side members 12 and parallel interior members 12', the latter being connected to the side members 12 by the bridging members 14' and end members 14''. It will thus be seen that when viewed in plan as shown in FIG. 8, the modules $M_2$ have a generally U-shaped configuration, with an openended mandrel receiving space, the purpose of which will hereinafter be described, being provided between the interior side members 12'. All of the table rollers 16, 16' are interconnected by a system of sheaves or sprockets 36 and belts or chains 37, with driving power again being provided from a common underlying drive including a gear reducer 22 and motor 24.

A further and more complete description of the roller table modules $M_1$ and $M_2$ is provided in a separate application assigned to the same assignee as that of the present application. For purposes of the present discussion, it will be understood that the roller table modules $M_1$ and $M_2$ are adapted for mounting at appropriate positions along the path of coil travel through a coil handling area. The modules are each separately powered by means located beneath the conveying plane defined by the table rollers. The modules are adapted to facilitate their rapid interchangeability, which of course is advantageous from a maintenance standpoint. When aligned longitudinally as shown for example in FIG. 1, the roller table modules $M_1$ and $M_2$ provide roller conveyor avenues $a_1$ and $a_2$.

Where the coils being handled are relatively small and thus dimensionally stable, they may be carried from one location to another directly on the roller table modules $M_1$ and $M_2$. However, where the coils are larger, as is frequently the case in modern mills, it may be necessary to provide a support means to insure that the coils do not distort or topple while in transit. To this end, pallets 44 of the type shown in FIG. 3 may be employed. The pallets 44 are the subject of a separate application assigned to the same assignee as that of the present application. Accordingly, only a brief description will be provided at this time.

The pallets 44 are each provided with a generally U-shaped base made up of laterally spaced leg members 45 interconnected at their rearward ends by a bridging member 46. The upper surfaces 47 of the leg members are inclined downwardly from front to rear. Support posts 48 extend vertically from the upper surfaces 47. The support posts are braced by rearward brackets 49 which rest on and are removably attached to the bridging member 46. when loaded on the pallet 44, a coil C will have its bottom resting on the upper surfaces 47 of the leg members 45. The coil will be inclined slightly and will thus lean against the support posts 48. In this way, the coil will remain in a stable upstanding condition throughout its travel through a coil handling area. The distance between the exterior sides of the leg members 45 is such that the pallets can readily move along the roller table modules $M_1$ and $M_2$, with the side channels 12 of the modules acting as guides.

Returning now to FIGS. 1 and 2, it will be seen that the compacting station B includes a base platen 52 having laterally opposed sections **52*a*, 52*b* with a space 54 therebetween. An upper platen 56 overlies the base platen 52 and is mounted for vertical movement on an upstanding support 58. The upper platen is moved vertically relative to the base platen by a first operating means which includes a pair of piston-cylinder assemblies 60.**

A carriage assembly 62 is located beneath the level of base platen 52. The carriage assembly has wheels 64 arranged to run along rails or tracks 66 which have inclined portions 66' located beneath the receiving station A. The carriage assembly 62 has a depending trunk 68 slidably containing an axially movable mandrel 70. The mandrel is axially extended and retracted by a second operating means which again comprises a piston-cylinder assembly 72 supported within the trunk 68.

The carriage assembly 62 also includes a vertically movable elevator head 76. the elevator head is mounted on the carriage assembly 62 by means of spring-loaded rods 78. As is best shown in FIG. 2, the width of the elevator head 76 is slightly less than that of the space 54 between the two sections **52*a*, 52*b* of base platen 52. The mandrel 70 is arranged to move axially through the elevator head 76. Fingers 80 on the mandrel 70 are arranged to engage the elevator head during the latter portion of the mandrel's extension to thus raise the elevator head 76 relative to the carriage assembly 62. The carriage assembly 62 is moved in opposite directions along the rails or tracks 66 by a third operating means which includes a piston-cylinder assembly 82.**

Figure 11A:
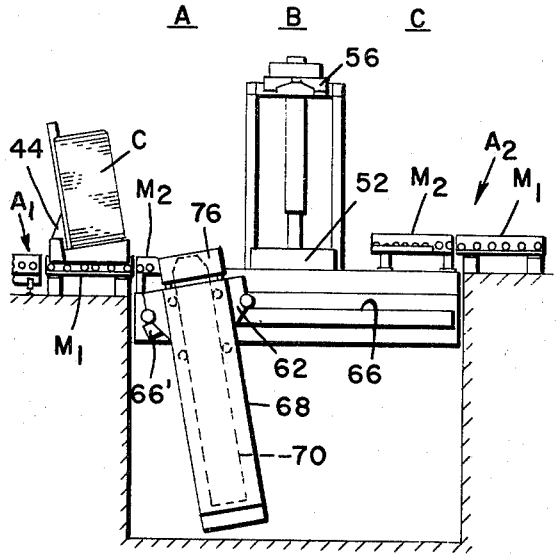
FIGS. 11A – 11H are schematic illustrations showing the operational sequence of the present invention.

With reference now to FIGS. 11A-11H, it will be seen that the coil compactor of the present invention operates in the following manner: at the operational stage shown in FIG. 11A, a coil C supported on a pallet 44 has been delivered along conveyor avenue $a_1$ onto a roller table module $M_1$ which is directly adjacent to the end roller table module $M_2$ at the receiving station A. The carriage assembly 62 has been moved along tracks 66 to a location beneath receiving station A. The carriage assembly and its associated components, including the mandrel 70 and elevator head 76, are all inclined due to the fact that the carriage wheels are partially supported by the inclined portion 66' of the track 66.

Figure 11B:
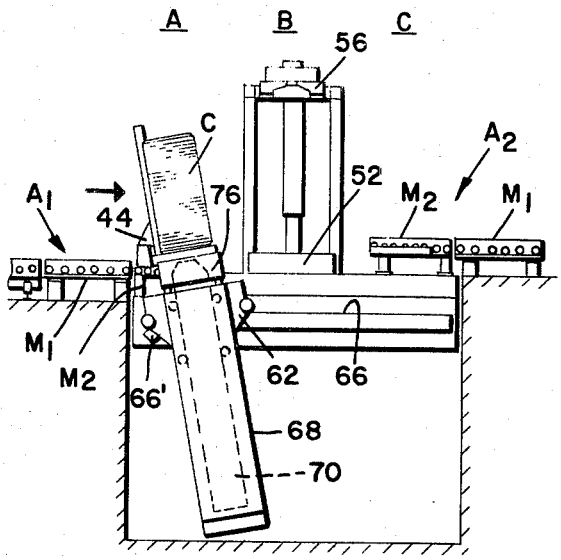

FIG. 11B depicts the next operational stage which involves energizing both the roller table module $M_1$ supporting the loaded pallet 44 and the adjacent roller table module $M_2$ to transfer the loaded pallet onto the roller table module $M_2$ at the receiving station A. This places the loaded pallet 44 over the carriage assembly 62 with the eye of the coil C aligned axially with the underlying inclined mandrel 70, the latter remaining fully retracted beneath the coil C.

Figure 11C:
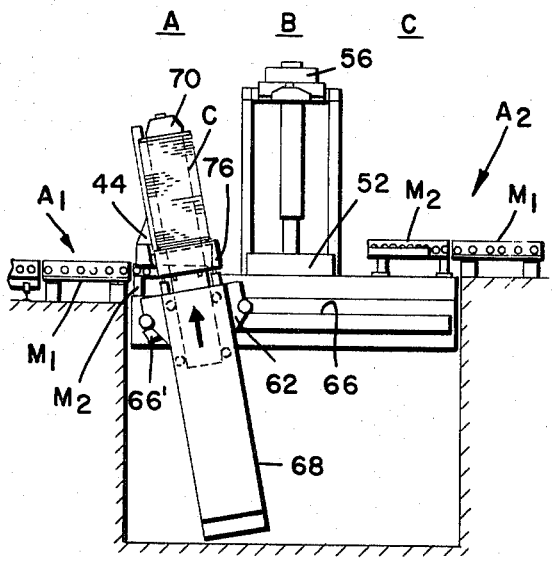
Figure 11D:
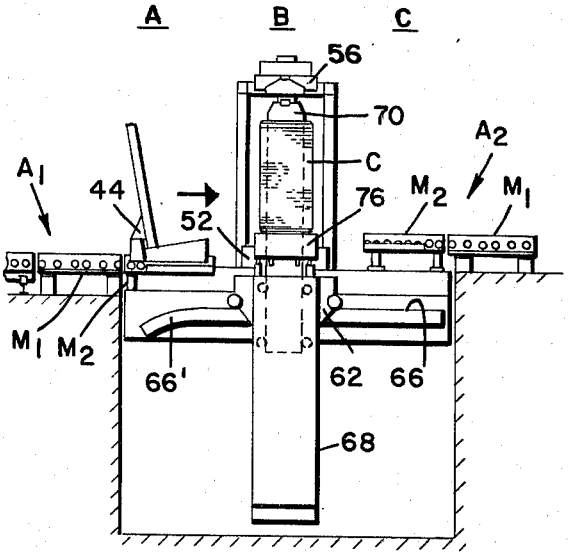

Referring next to FIG. 11C, it will be seen that the mandrel 70 is next extended axially and is thus inserted through the coil C. During the last segment of the mandrel extension, the mandrel fingers 80 (see FIG. 1) engage the elevator head 76, causing the elevator head to contact and raise the bottom of the coil C off of the base of the pallet 44. Accordingly, at the end of this operational stage, the coil C is completely supported on the mandrel 70 and the raised elevator head 76. Referring next to FIG. 11D, it will be seen that the carriage assembly 62 is moved along tracks 66 to the compacting station B. The space 54 between the two sections 52*a*, 52*b* of the lower platen 52 accommodates positioning therebetween of the raised mandrel 70 and the elevator head 76. At this stage, the coil C remains supported from beneath on the elevator head 76, the latter being elevated slightly above the base platen 52.

Figure 11E:
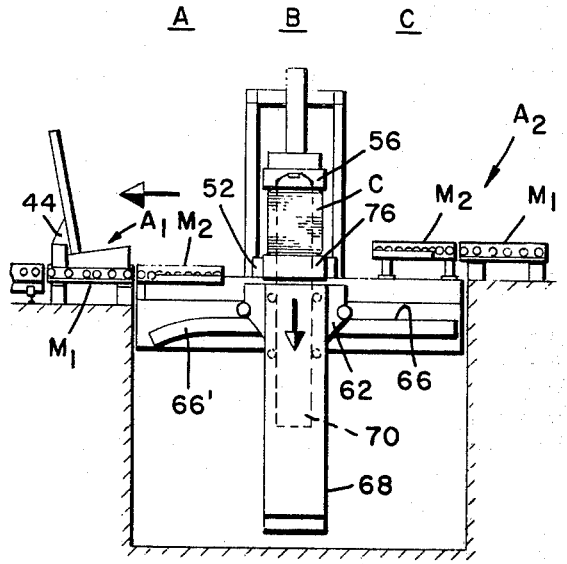

As is next shown in FIG. 11E, axial compaction of the coil C is accomplished by lowering the upper platen 56. As the upper platen 56 is lowered, a nose 84 on the platen enters a socket 86 on the upper end of the mandrel, thereby providing support for the upper end of the mandrel and a rigid interlock between the mandrel and the upper platen. Following the entry of nose 84 into socket 86, and as the upper platen continues to descend, the mandrel 70 is gradually retracted at a rate corresponding to that of the descent of the upper platen. This initially causes the elevator head 76 to drop into horizontal alignment with base platen 52. Thereafter, as the upper platen continues to descent with an accompanying gradual retraction of the mandrel 70, the net result is an axial compaction of the coil C between the upper and base platens 56, 52 while the coils remains supported axially from within by the mandrel 70. While this operation is taking place, the end modules $M_1$ and $M_2$ of avenue $a_1$ are energized to laterally remove the unloaded pallet 44. With the coil thus fully compacted, a plurality of retaining bands are applied. This can be accomplished automatically by suitable banding apparatus (not shown), or it can be accomplished manually.

Figure 11F:
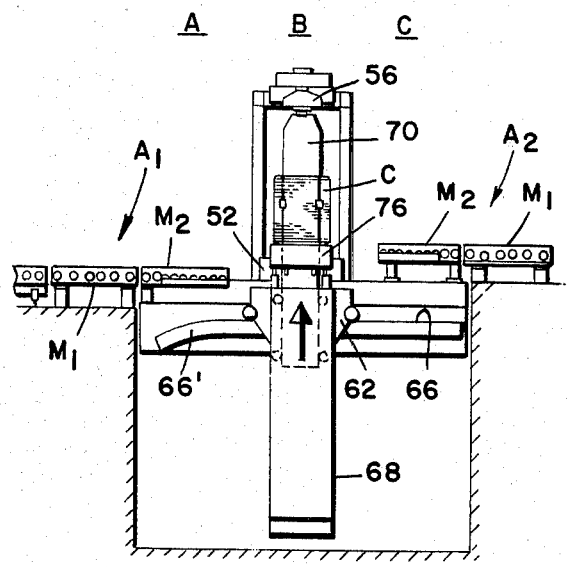

After the banding operation has been completed, the upper platen 56 is returned to its raised position and this is accompanied by an extension of the mandrel 70 and a raising of the elvator head 76 to the positions shown in FIG. 11F. It will thus be understood that at this point, the compacted banded coil C is again totally supported on the elevator head 76 and the mandrel 70.

Figure 11G:
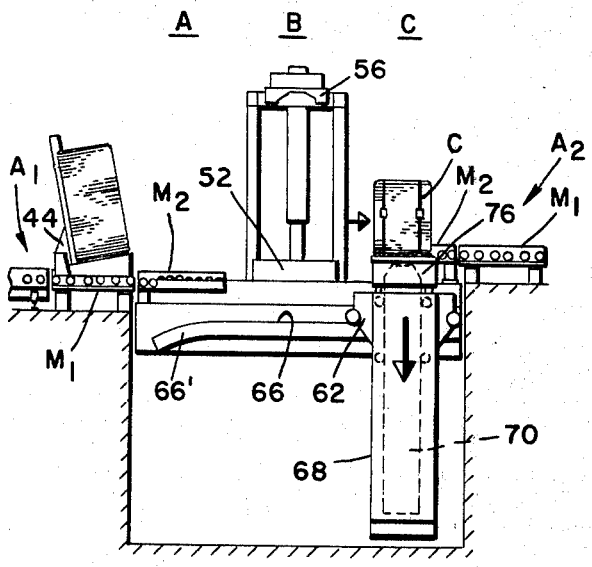
Figure 11H:
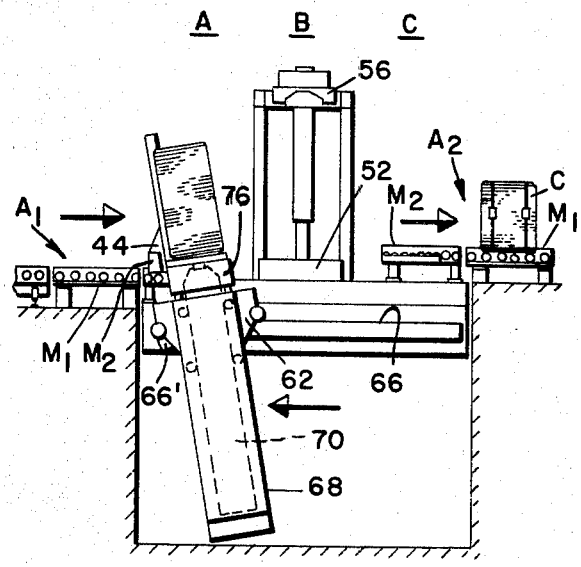

Thereafter, as shown in FIG. 11G, the carriage assembly 62 is moved along tracks 66 to a position underlying the end module $M_2$ of avenue $a_2$ at delivery station C. This having been accomplished, the mandrel 70 is fully retracted with the result that the compacted banded coil is deposited on the underlying roller table module $M_2$. Finally, with reference to FIG. 11H, it will be seen that the roller table modules $M_2$ and $M_1$ of avenue $a_2$ are energized to move the coil away from the compacting mechanism while the carriage assembly 62 and its associated components are returned along track 66 to pick up another coil at the receiving station A.

In light of the foregoing, it will now be evident to those skilled in the art that the present invention offers several significant advantages. For example, whenever a coil is to be transferred laterally, such as from the receiving station A to the compacting station B, or from the compacting station to the delivery station C, this lateral transfer will occur, while the coil is being supported from the bottom by the elevator head 76 and from within by the mandrel extending axially through the coil. This avoids sliding contact between the coil bottom and underlying support surfaces which could mar or scratch the coiled product. It also eliminates the possibility of the coil being toppled or otherwise distorted during lateral transit.

Axial support for the coil remains throughout compaction. This either eliminates or at least substantially reduces telescoping of the product rings, thereby further improving the shape and integrity of the resulting compacted banded coil.

It is my intention to cover all changes and modifications of the embodiment herein chosen for purposes of disclosure which do not depart from the spirit and scope of the invention as claimed.

I claim:

1. In a rolling mill, apparatus for axially compacting an upstanding cylindrical product coil, comprising: a base platen divided into laterally spaced sections; an upper platen overlying and spaced vertically above said base platen; transport means for moving an upstanding coil laterally into an operative position between said platens, said transport means including an elongated mandrel extending axially through the coil and an elevator head raised by said mandrel to a position supporting the coil bottom at a level above said base platen, and a first operating means for lowering said upper platen, the descent of said upper platen being accompanied by a corresponding axial lowering of said mandrel under the influence of a second operating means and a lowering of said elevator head to the level of said base platen, with the result that the coil is axially compacted between said platens while being supported internally by said mandrel.

2. The apparatus as claimed in claim 1 wherein said upper and lower platens and said first operating means comprise the basic elements of a compacting station which is located between a receiving station and a delivery station, and wherein said apparatus further comprises rail means underlying said stations and along which said transport means is arranged to run under the influence of a third operating means.

3. The apparatus as claimed in claim 2 wherein said transport means includes a carriage movably mounted on said rail means, said elevator head being mounted on and movable vertically relative to said carriage, said mandrel being mounted on and movable axially relative to both said carriage and said elevator head, said mandrel having finger means arranged to engage and move said elevator head, said second operating means also being mounted on said carriage.

4. The apparatus as claimed in claim 1 wherein said upper platen is provided with a nose arranged to be received in a socket at the upper end of said mandrel.

5. The apparatus as claimed in claim 3 wherein means are provided at said receiving station for supporting a coil on a U-shaped support with the open side of said support facing said compacting station and wherein the arrangement of said rail means is such that when said carriage is located by said third operating means beneath said receiving station, with said mandrel fully retracted by said second operating means, the axes of said coil and said mandrel will be arranged coaxially with the upper end of said mandrel and said elevator head located beneath the coil bottom, whereupon said second operating means may then be employed to axially insert said mandrel through said coil, with the said finger means engaging and raising said elevator head to contact the coil bottom and lift the coil off of said U-shaped support.

6. The apparatus as claimed in claim 5 wherein the U-shaped support at said receiving station is arranged to support the coil at an inclined angle relative to the vertical and wherein said rail means at said receiving station is inclined at the same angle relative to the horizontal.

7. The apparatus as claimed in claim 5 further characterized by a U-shaped coil support at said delivery station, with the open end of said U-shaped support facing said compacting station, whereupon following compaction of a coil at said compacting station and the application of suitable banding means to contain the coil in its compacted state, said first and second operating means may be employed to place the compacted banded coil at an elevated position out of contact with said platens and supported solely by said mandrel and said elevator head after which said third operating means may be employed to shift said transport means to said delivery station with the compacted banded coil supported on said elevator head above said U-shaped coil support and said second operating means may then be employed to deposit the compacted banded coil on said U-shaped coil support with said mandrel fully retracted from the coil.

8. The apparatus as claimed in claim 7 wherein said U-shaped coil support comprises a self-contained powered roller table module.

* * * * *